United States Patent [19]

Wilson

[11] 4,410,114

[45] Oct. 18, 1983

[54] COMBINED TOOL FOR NEEDLEWORK

[76] Inventor: Norma K. Wilson, 10 Adams Ave., Pitman, N.J. 08071

[21] Appl. No.: 335,242

[22] Filed: Dec. 28, 1981

[51] Int. Cl.[3] ..... D05B 87/00

[52] U.S. Cl. ..... 223/99; 7/125

[58] Field of Search ..... 81/43; 7/125; 128/340; 223/99, 102

[56] References Cited

U.S. PATENT DOCUMENTS

| | | | |
|---|---|---|---|
| 696,995 | 4/1902 | Moser | 7/125 X |
| 888,977 | 5/1908 | Early | 223/99 |
| 951,891 | 3/1910 | Wallace | 81/43 X |
| 1,230,142 | 6/1917 | Erringer | 81/43 X |
| 1,504,917 | 8/1924 | Trzeciak | 223/99 |
| 2,416,260 | 2/1947 | Karle | 128/340 |
| 3,250,447 | 5/1966 | Larew | 223/99 |
| 3,838,801 | 10/1974 | David | 223/99 |
| 3,840,160 | 10/1974 | Pearce | 223/99 |
| 4,124,153 | 11/1978 | Mann | 223/102 |

FOREIGN PATENT DOCUMENTS

| | | | |
|---|---|---|---|
| 446935 | 3/1948 | Canada | 223/102 |

*Primary Examiner*—Louis Rimrodt

*Attorney, Agent, or Firm*—Duffield & Lehrer

[57] ABSTRACT

An elongated support member has a curved and pointed pick adjacent one end thereof. The other end of the support member is formed into a pair of tweezers. Mounted on the free end of each tong of the tweezers is a flat thin needle threader. To greatly facilitate their use and operation, the needle threaders extend outwardly to the sides and lie in a plane which is at a 30° to 45° angle to the axis of the support member.

8 Claims, 3 Drawing Figures

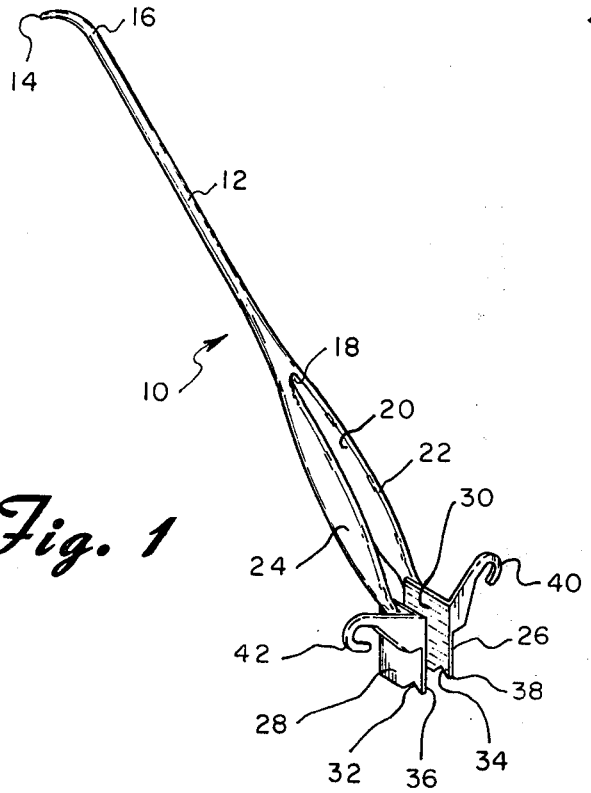
Fig. 1
Fig. 2
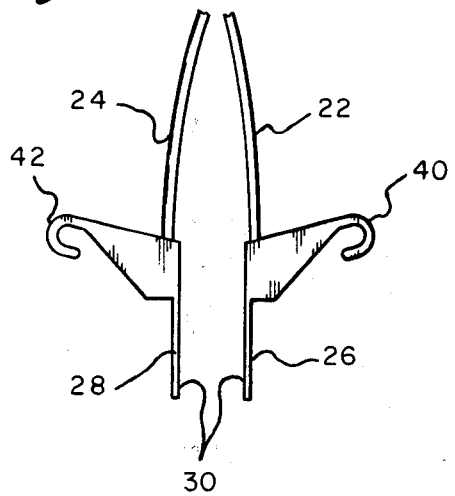
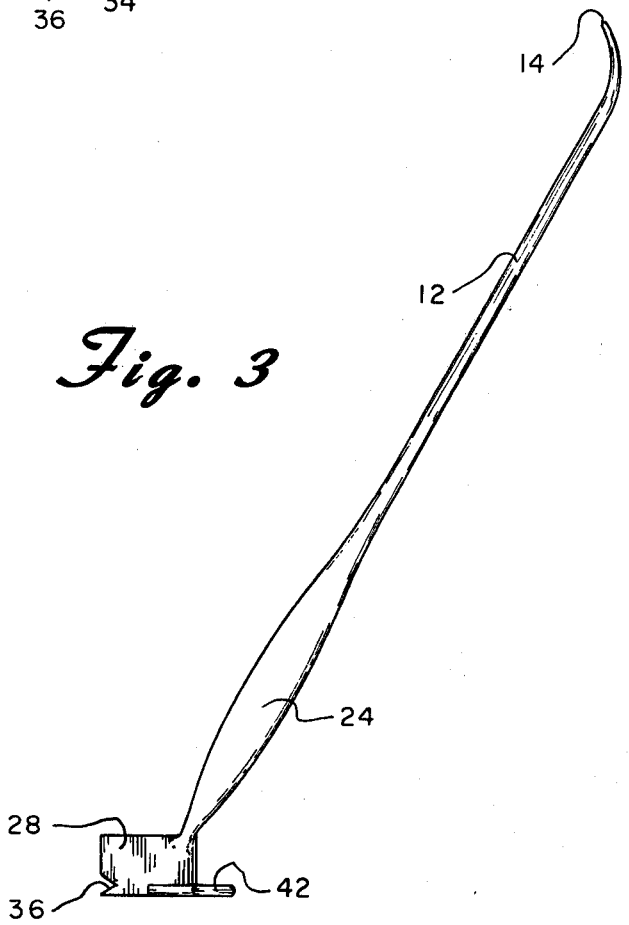
Fig. 3

COMBINED TOOL FOR NEEDLEWORK

BACKGROUND OF THE INVENTION

The present invention is directed toward a combined tool for needlework and more particularly toward a tool which includes a pick, a pair of tweezers and a pair of needle threaders all arranged so as to be conveniently and easily utilized primarily for, but not limited to, needlework stitch correction and repair procedures.

Removing and replacing isolated or multiple stitches are functions which usually are involved in most forms of embroidery and canvas work. While not necessarily designed for this procedure, the implements and devices most commonly used includes the stitching needle, needle threader, thimble and tweezers. These stitching aids are generally acceptable for use with hand-held ground fabrics where the fabric remains flexible and easily manipulated for performing various stitching procedures. However, they have certain limitations when used on ground fabric, particularly needlepoint canvas, that is tightly stretched and securely mounted to a needlework frame, where the fabric remains taut and cannot be manipulated as needed.

To explain these limitations, when working on frame-mounted fabric, the stitcher is restricted not only to a flat, unflexible surface, but also to the confines of the needlework frame. As a result, several of the implements or devices which normlly are used for hand-held stitching often are rendered inadequate, or must be manipulated and maneuvered to perform as desired. Specifically, embroidery and tapestry needles are characteristically short, straight and thin, making their use impractical for lifting and removing larger areas of stitching from a firm flat surface. Needle threaders, as described in U.S. Pat. Nos. 3,838,801 and 3,840,160 are designed primarily for threading hand-held needles rather than needles positioned under worked stitches. Because of their thin flat design, they can be awkward to handle and difficult to maneuver when threading a positioned needle lying substantially on a flat taut surface, and particularly when threading said needle with very short yarn and thread lengths. The rounded shape of a conventional thimble makes it difficult to position for proper contact with the ends of a needle positioned on a taut flat stitched surface.

At the present time, there is no single device known to Applicant which has been developed for correcting stitching errors and which can be used interchangeably with the different methods of stitching. However, several attempts have been made in the past to combine two primary tools into a single useful device. For example, U.S. Pat. Nos. 951,891 and 1,230,142 describe devices which have a curved hook or pick-like element at one end thereof and tweezers adjacent the other end. U.S. Pat. No. 2,416,260, on the other hand, discloses a device which includes a pick element adjacent one end and retractable needle threader at the other end thereof. None of these patents, nor any others known to Applicant, however, combine all three tools in a single device nor are they conveniently arranged with respect to each other so as to be particularly useful for needlework.

SUMMARY OF THE INVENTION

The present invention overcomes the deficiencies of the prior art and provides a tool which combines the most needed components into a single device. According to the invention, an elongated support member has a curved and pointed pick adjacent one end thereof. The other end of the support member is formed into a pair of tweezers. Mounted on the free end of each tong of the tweezers is a flat thin needle threader. To greatly facilitate their use and operation, the needle threaders extend outwardly to the sides and lie in a plane which is at a 30° to 45° angle to the axis of the support member.

BRIEF DESCRIPTION OF THE DRAWING

For the purpose of illustrating the invention, there is shown in the accompanying drawing one form which is presently preferred; is being understood that the invention is not intended to be limited to the precise arrangements and instrumentalities shown.

FIG. 1 is a front perspective view of a combined tool for needlework constructed in accordance with the principles of the present invention;

FIG. 2 is a front elevational view of the lower portion of the tool shown in FIG. 1, and FIG. 3 is a side elevational view of the tool.

DETAILED DESCRIPTION OF THE PREFERRED EMBODIMENT

Referring now to the drawing in detail wherein like reference numerals have been used throughout the various figures to designate like elements, there is shown in FIG. 1 a combined tool for needlework constructed in accordance with the principles of the present invention and designated generally at 10. The tool includes an elongated support member 12, the upper half of which is substantially circular in cross section. The top end of the support member 12 tapers substantially to a fine blunt point 14 and is curved as shown at 16 to form a pick for lifting and removing needlework stitches.

The lower portion of the support member 12 is bifurcated at 18 so as to form a pair of tweezers 20 having tongs 22 and 24. Preferably, the support member 12 and the tweezers 20 are comprised of stainless steel or some similar metal. In this way, the tweezers are normally spring biased outwardly.

The free end of each of the tongs 22 and 24 is enlarged so as to have a substantially flat surface such as shown at 26 and 28 and are designed for multiple uses. A plurality of grooves and/or ribs 30 may be formed on the inner surfaces of the elements 26 and 28 in order to increase the gripping strength of the tweezers. A V-shaped cutout such as shown at 32 and 34 is formed in the elements 26 and 28 so that points 36 and 38 remain. These points provide the tool with a very fine tweezer which is capable of lifting and holding onto a single thread or the like.

In addition to serving as a dual purpose tweezer, elements 26 and 28 of tong ends 22 and 24, when positioned as in FIG. 1, also serve as a modified thimble by providing a broad flat surface and edge with which to make contact with both the needle ends and taut flat stitched surface. Points 36 and 38 of elements 26 and 28, when positioned as in FIG. 3 for insertion through the eye of a needle, are capable of gripping, lifting and retracting a needle burrowed or lodged under worked stitches.

Extending outwardly to either side of the tweezers 20 and adjacent the free ends of the tongs 22 and 24 are needle threaders 40 and 42. Each needle threader is comprised of substantially thin and planar sheet metal and is, per se, shaped in a conventional manner and of a width narrow enough so as to be inserted through the eye of most embroidery and tapestry needles. As shown most clearly in FIG. 3, however, the needle threaders 40 and 42 lie in substantially the same plane which is intersected by the axis of the support member 12 at an angle of approximately 30° to 45° from the vertical. This allows the tool shown in FIG. 3 to be held in substantially the same manner as a pencil with the tweezer ends and the needle threaders lying substantially flat on a work surface. This is particularly useful when it is desired to thread a positioned needle which is lying substantially on a flat taut work surface. Prior art devices are incapable of accomplishing this with the ease and efficiency of the present invention.

The present invention may be embodied in other specific forms without departing from the spirit or essential attributes thereof and accordingly, reference should be made to the appended claims rather than to the foregoing specification as indicating the scope of the invention.

I claim:

1. A combined tool for needlework including:

an elongated support member;

said support member tapering substantially to a point adjacent one end thereof, said one end being curved so as to form a pick;

a pair of needle threaders mounted adjacent the other end of said support member, said needle threaders lying in the same first plane and being comprised of substantially thin planar metal and extending outwardly from opposite sides of said support member;

the axis of said support member intersecting said first plane and lying in a second plane which differs from said first plane.

2. A combined tool as claimed in claim 1 wherein the axis of said support member intersects the plane of said needle threaders at an angle of between approximately 30° and 45° from the vertical.

3. A combined tool as claimed in claim 1 wherein the other end of said support member is bifurcated to form tweezers.

4. A combined tool as claimed in claim 3 wherein said needle threaders are mounted adjacent the free end of one of the tongs of said tweezers.

5. A combined tool for needlework including:

an elongated support member;

said support member tapering substantially to a point adjacent one end thereof, said one end being curved so as to form a pick;

the other end of said support member being bifurcated to form tweezers;

a needle threader mounted adjacent said other end of said support member, said needle threader being comprised of a substantially thin planar metal and extending outwardly from one side of said support member.

6. A combined tool as claimed in claim 5 wherein said needle threader is mounted adjacent the free end of one of the tongs of said tweezers.

7. A combined tool as claimed in claim 6 further including a second needle threader, said second needle threader being substantially identical to said first needle threader and being mounted adjacent the free end of the other tong of said tweezers, said second needle threader extending outwardly in the opposite direction of said first needle threader.

8. A combined tool as claimed in claim 7 wherein the axis of said support member intersects the plane of said needle threaders at an angle of between approximately 30° and 45° from the vertical.

* * * * *